United States Patent [19]

Bradshaw

[11] 4,373,495

[45] Feb. 15, 1983

[54] PRESSURE TRANSDUCER FOR EXHAUST GAS RECIRCULATION SYSTEM

[75] Inventor: Cyril E. Bradshaw, Kalamazoo, Mich.

[73] Assignee: Eaton Corporation, Cleveland, Ohio

[21] Appl. No.: 211,014

[22] Filed: Nov. 28, 1980

[51] Int. Cl.[3] ..... F02M 25/06

[52] U.S. Cl. ..... 123/568

[58] Field of Search ..... 123/568

[56] References Cited

U.S. PATENT DOCUMENTS 4,173,204 11/1979 Takayama et al. ..... 123/568

4,195,605 4/1980 Weathers et al. ..... 123/568

*Primary Examiner*—Wendell E. Burns

*Attorney, Agent, or Firm*—C. H. Grace; R. A. Johnston

[57] ABSTRACT

A pressure transducer (10) for use in internal combustion engine exhaust gas recirculation systems is disclosed having low inertia moving components for improved response time and a low cost diaphragm mounting arrangement. Upper (12) and lower (14) housing shells define in cooperation with a diaphragm (21) and an upper (26) and lower (44) reaction plates fabricated from light weight plastic, a vacuum chamber (72), control chamber (96) and a vent chamber (102). The single diaphragm is connected to the inner wall of the housing by a clamping ring (48), thereby dividing the diaphragm into individually pressure responsive upper and lower portions.

15 Claims, 6 Drawing Figures

PRESSURE TRANSDUCER FOR EXHAUST GAS RECIRCULATION SYSTEM

BACKGROUND OF THE INVENTION

This invention relates to pressure transducers for use in internal combustion engine exhaust gas recirculation (EGR) systems and is particularly suited for use in those EGR systems which incorporate vacuum operated devices for controlling EGR. The invention relates particularly to devices employing carburetor venturi vacuum or suction as a source of signal pressure for controlling EGR. Venturi suction provides a pressure signal indicative of engine air mass flow and is a convenient signal source having characteristics which vary in the opposite sense of engine induction manifold depression. Where it is desired to control EGR as a function of air mass flow venturi suction can be readily utilized. More particularly the invention relates to EGR controllers responsive to venturi suction or venturi vacuum transducers as they are known.

DESCRIPTION OF THE PRIOR ART

Venturi vacuum transducers are known in the art to control EGR flow valves in response to a subatmospheric pressure signal, known as venturi suction, produced by intake air flowing through a carburetor venturi passageway, and a pressure signal produced by the flow of recirculated exhaust gas.

One such known transducer incorporates a pair of flexible diaphragms each of which is clamped between a pair of rigid plates. Another transducer known in the art utilizes three flexible diaphragms and numerous support and reaction plates. The complexity and mass inertia of these supports and plates tends to slow and limit the responsiveness of the transducer to rapid or small signal pressure changes. Thus it has been desired to find a way to reduce the mass and consequently the inertia of the moving components in order to increase response time and improve sensitivity to low magnitude pressure differentials acting across the transducer diaphragms.

A further need in such devices is for cost reduction which can be achieved by reducing the number of component parts and simplifying assembly procedures.

SUMMARY OF THE INVENTION

In the present invention an improved pressure transducer, known in the art as a vacuum venturi transducer, is disclosed which has a reduced number of component parts as compared to prior art devices. The unique simplicity of the invention transducer construction provides improved manufacturability and less costly assembly.

In the preferred embodiment the invention is shown and described as including a two-piece molded thermoplastic housing construction which is retained in assembly by snap lock tabs and/or sonic welding. The two-piece housing includes upper and lower housing shells defining a cavity in which is mounted a single flexible diaphragm. A clamping ring formed of molded thermoplastic clamps the diaphragm around a circumferential surface area at a position radially inward from its periphery, thereby separating the diaphragm into upper and lower pressure responsive surface portions. The outer surface of the clamping ring is tapered and engages with a corresponding tapered surface located on the inside surface of the lower housing shell. Snap-locking tabs on the clamping ring engage with corresponding slots in the lower housing shell and are configured to exert a downward force on the clamping ring which functions to sealingly clamp the diaphragm therebetween.

A thermoplastic reaction plate assembly is connected to the upper diaphragm portion by means of a thickened portion which extends into an annular groove molded into the diaphragm. The differential pressure acting across the upper diaphragm portion tends to force the groove toward the bead portion of the reaction plate for sealing, thereby eliminating the need for separate fasteners. The reaction plate assembly includes a lower plate connected to the upper reaction plate by a sonic welded rivet and functions to clamp the lower diaphragm portion therebetween. Preferably both the upper and lower reaction plates are formed of injection molded thermoplastic, thereby resulting in a lightweight construction.

It is an object of the invention to provide a pressure transducer having low inertia moving parts and which has a fast response to low magnitude changes in pressure differentials.

It is an object of the invention to provide a pressure transducer of the type described above having a minimal number of component parts.

It is another object of the invention to provide a pressure transducer which is easy to assemble. A further object of the invention is to provide vacuum venturi transducer which has low inertia for its moving components.

These and other objects, features, and advantages of the present invention will be understood in greater detail from the following description and associated drawings wherein reference numerals are utilized in designating preferred embodiments.

DETAILED DESCRIPTION

Figure 1:
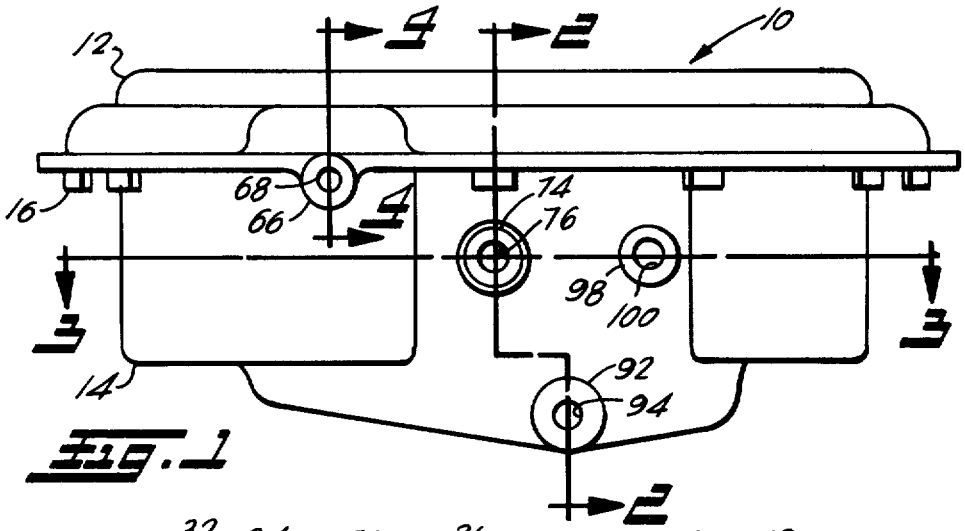
FIG. 1 is a view in elevation of a pressure transducer embodying the principles of the invention.

Referring now to FIGS. 1–4, there is indicated generally by reference numeral 10 a pressure transducer embodying the principles of the invention. Transducer 10 includes an upper housing shell 12 connected to a lower housing shell 14 by means of sonic welding and a plurality of locating tabs 16 which extend through aligned openings 18 formed through the outer periphery of a flanged portion 20 formed by lower housing shell 14.

A diaphragm 21 includes a peripheral bead portion 22 which is sealingly crimped between the upper surface of flanged portion 20 and an annular groove 24 formed in the outer periphery of upper housing shell 12.

An upper diaphragm reaction plate 26 includes an upper flanged portion 28 and a downwardly extending tubular portion 30. An enlarged bead portion 32 is formed around the periphery of flange 28 and is seated in a corresponding annular groove portion 34 formed in diaphragm 21.

A downwardly extending tubular portion 36 is defined by upper housing shell 12 and includes an annular shoulder portion 38 formed on the lower end thereof.

Tubular portion 36 also functions to limit radial movement of reaction plate 26.

A compression biasing spring 40 has an upper end seated against shoulder 38 and a lower end reacting against an upper transverse surface 42 formed at the lower end of tubular extension 30.

A lower diaphragm plate 44 includes a centrally located upwardly projecting rivet portion 46 which extends through an opening in the lower end of tubular extension 30 and an opening in the diaphragm. Upper and lower reaction plates 26, 44 are preferably fabricated from light weight injection molded thermoplastic. The riveted connection is made by a suitable heat forming process, for example, sonic welding, and sealingly clamps the central portion of diaphragm 20 between plate 44 and the lower surface of tubular extension 30.

Figure 2:
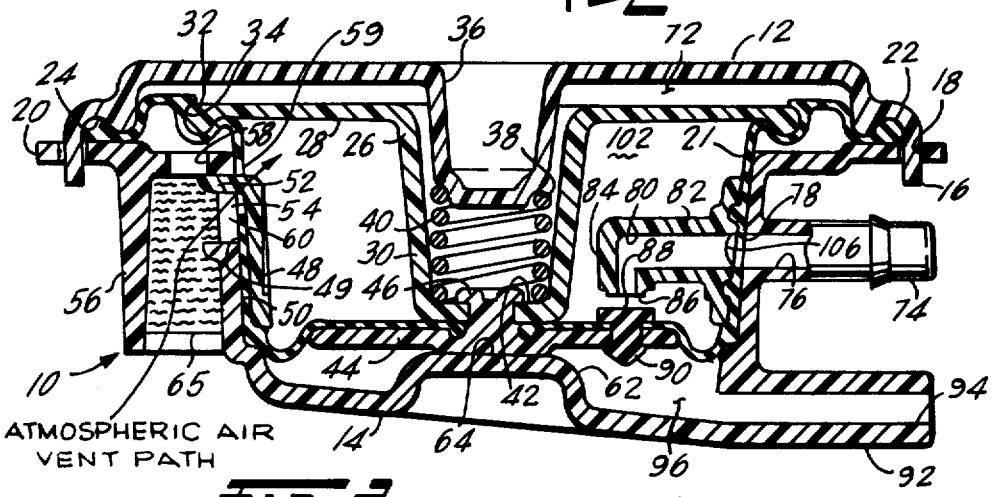
FIG. 2 is a cross-sectional view taken along section lines 2—2 of FIG. 1.

A clamping ring 48 includes an outer, tapered surface 49 which clamps a portion of diaphragm 20 against an annular surface portion 50 of lower housing shell 14. A plurality of circumferentially spaced radially extending tabs 52 only one of which is shown in FIG. 2, extend through corresponding openings 54 formed through the side wall of housing shell 14 and abut against the lower surface of a "T"-shaped slot shown from the side only by FIG. 2. Tabs 52 are positioned relative to the tapered side wall so as to exert a downward spring force on insert 48 whereby the tapered outer wall thereof provides a compressive load against diaphragm 20. Clamping of the single diaphragm in this manner effectively isolates the diaphragm into upper and lower portions which are responsive to pressure differentials acting thereacross independently of each other.

Downwardly opening tubular boss portions 56 (one shown partially by FIG. 2) are defined by lower housing shell 14 and positioned at three equally spaced locations. Openings 58 and 60 formed through the walls of lower housing shell 14 at three circumferentially spaced locations (one shown by FIG. 2) and an opening 59 in diaphragm 21 function as vent orifices for communicating atmospheric air to the space beneath the upper reaction plate 26. The path of the atmospheric air is shown by the black arrows of FIG. 2.

A centrally located raised portion 62 extends upwardly from the lower surface of housing shell 14 and defines an upper stop surface 64 which limits downward motion of the upper and lower diaphragm plates 26, 44 as urged downwardly thereagainst by biasing spring 40.

Porous filters 65 are received in each of the openings defined by boss 56 and function to filter atmospheric air communicated internally of the transducer.

Figure 4:
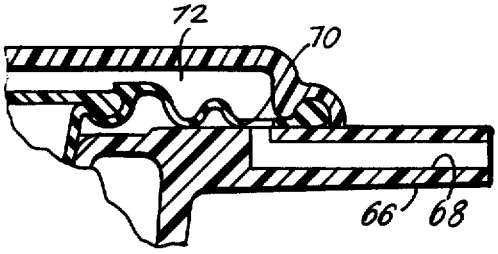
FIG. 4 is a cross-sectional view taken along section lines 4—4 of FIG. 1.
Figure 5:
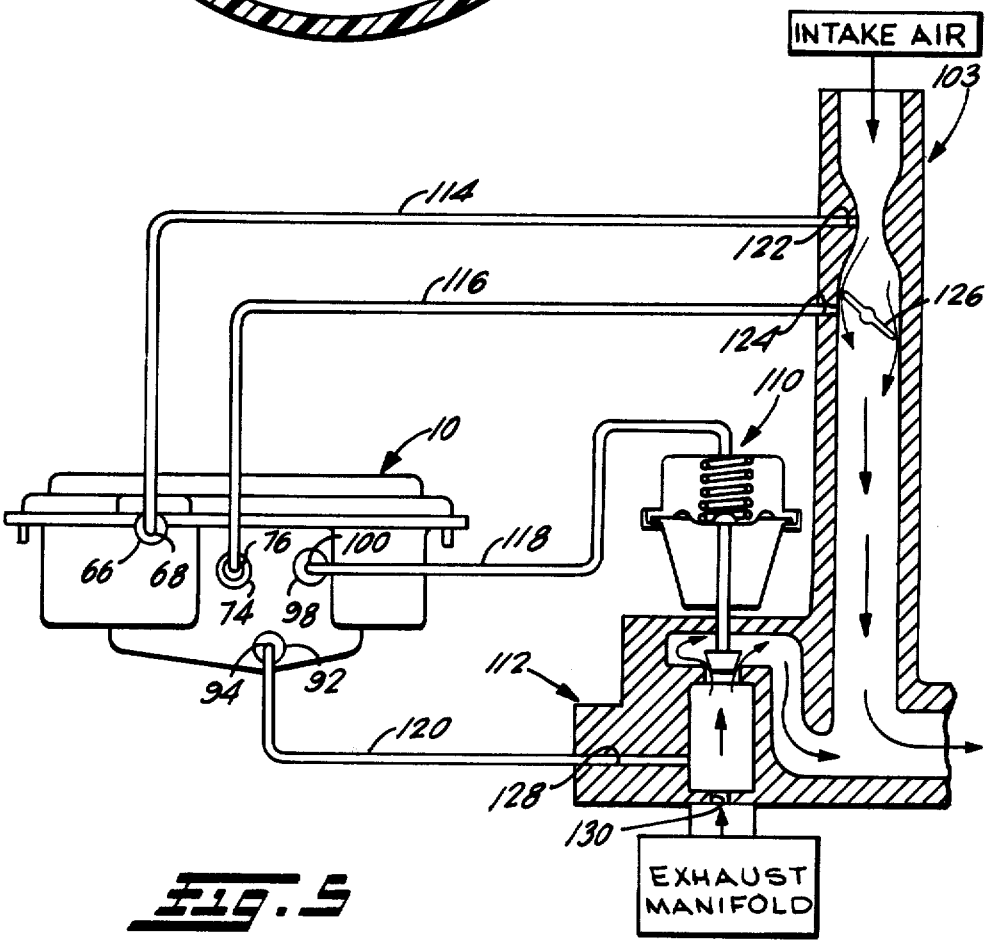
FIG. 5 is a schematic illustration of an internal combustion engine exhaust gas recirculation system which embodies the transducer of FIGS. 1 through 4; and, FIG. 6 is a graph of control pressure versus venturi vacuum for the system of FIG. 5.

As shown in FIGS. 4 and 5, lower housing shell 14 includes a nipple extension 66 and a fluid port 68 which is in fluid communication with the space above diaphragm 21 and beneath the lower surface of upper housing shell 12 by means of an opening 70 in diaphragm 20. Fluid port 68 is also designated as a venturi vacuum port while the space above diaphragm 21 and beneath upper housing shell 12 is designated as a venturi vacuum chamber 72.

A nipple 74 extends outward radially from the side wall of lower housing shell 14 and defines a fluid port 76 therethrough. Port 76 is designated as a ported vacuum port and is in fluid communication with an aligned opening 78 in diaphragm 21 and a fluid passageway 80 defined by a tubular extension 82 integrally formed with 48. Extension 82 includes a downwardly extending vertical nozzle portion 84 which terminates in a valve seat portion 86. A corresponding valve surface 88 is defined by the top surface of a button-type insert 90 which extends through openings in diaphragm 21 and lower diaphragm plate 44. Insert 90 is formed of a suitable resilient elastomeric material and held in place by upper and lower flanged portions.

A nipple portion 92 is integrally formed by lower housing shell 14 and defines a fluid port 94 which is designated as a control pressure port. Port 94 functions to communicate fluid pressure to the space beneath the lower diaphragm portion and the upper surface of lower housing shell 14. The space between the lower diaphragm portion and housing shell 14 is designated as a control pressure fluid chamber 96.

Figure 3:
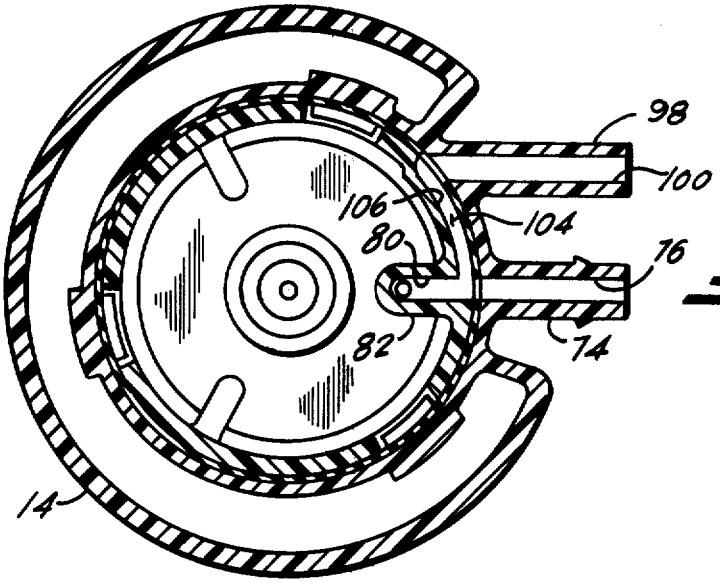
FIG. 3 is a cross-sectional view taken along section lines 3—3 of FIG. 1.

As shown by FIGS. 3 and 5 a nipple portion 98 is integrally formed by lower housing shell 14 and has a fluid port 100 formed therethrough. Fluid port 100 is designated as an output fluid port. The space between upper diaphragm plate 26 and the lower diaphragm portion is designated as an vent chamber 102. Fluid port 100 is in fluid communication with chamber 102.

Referring now to FIGS. 2 and 3, a linking passageway 104 is defined by a groove 106 formed into the outer surface of clamping ring 48 and surface portions of diaphragm 21.

Referring now to FIG. 5, vacuum venturi pressure transducer 10 is shown schematically in association with an internal combustion engine carburetor intake throat, indicated generally at 108, an exhaust gas recirculation valve, indicated generally at 110, and an exhaust gas recirculation manifold, indicated generally at 112. Fluid lines 114, 116, 118, and 120 connect, respectively, venturi vacuum port 68 with a venturi passageway 122 in intake 108, ported vacuum port 76 with a ported vacuum passageway 124 adjacent an engine throttle plate 126 and downstream from venturi passageway 122, output port 100 with EGR 110, and control port 94 with an EGR port 128 located downstream from an EGR orifice 130. EGR 110 is shown in an open position with the flow of recirculated exhaust gas and intake air represented by the arrows of FIG. 5.

Figure 6:
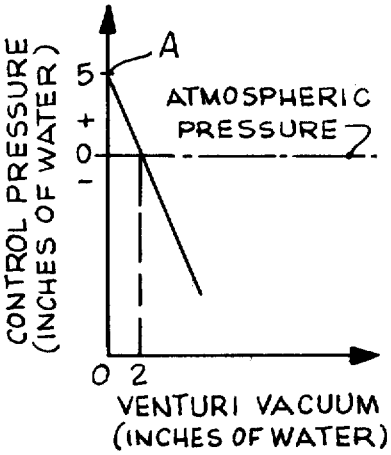

The principle of operation of the system described above is well known in the art and is based upon using a carburetor venturi vacuum reference signal which is indicative of an engine operating condition and comparing it to the pressure downstream of the EGR orifice 130, which is a function of the EGR flow rate. For any given engine operating condition, a pressure signal is developed at venturi passageway 122 and ported vacuum passageway 124 which are then communicated to venturi vacuum chamber 72 in transducer 10 (FIG. 2) and to nozzle extension 84 within vent chamber 102, respectively. A control pressure developed by the flow of recirculated exhaust gas past orifice 130 is communicated through orifice 128 and fluid line 120 to control pressure chamber 96. Assuming the engine operating condition is at idle, the venturi and ported vacuum signals at 122 and 124 are approximately at atmospheric pressure and the exhaust manifold pressure is above atmospheric pressure. This condition would be represented by point "A" on the graph of FIG. 6. The pressure in chamber 96 is sufficient to overcome the downward force of spring 40 and move valve surface 88 into sealing engagement with valve seat 86. Since the ported vacuum signal at passageway 124 is near atmospheric the spring in EGR 110 maintains the EGR pintle valve in the closed position, thus no EGR flow occurs. As the engine load increases from idle, the venturi vacuum and ported vacuum levels increase (a decrease in gauge pressure), causing a decrease in pressure to be communicated to the upper chamber of EGR 10, whereupon EGR 10 opens, allowing exhaust gas flow through manifold 112. Transducer 10 will then seek an equilibrium condition in which the forces on the upper diaphragm portion, the lower diaphragm portion, and biasing spring 40 are balanced resulting in valve surface 88 being positioned a predetermined space from valve 86. The position of valve seat 86 from valve surface 88 permits a predetermined amount of atmospheric vent air from vent chamber 102 to be communicated through passageways 80 and 104 and mix with the ported vacuum signal through fluid port 76. The resultant pressure signal from output port 100, through line 118 to EGR 110 will cause EGR 110 to open an amount sufficient to achieve a predetermined exhaust gas flow which is sensed within transducer 10 by the pressure in control chamber 96. A feedback loop is thus established by transducer 10 which allows for adjustment of EGR valve 110 open position if the rate of recirculated exhaust gas increases or decreases above the design equilibrium value. For example if the exhaust gas flow rate moves above the predetermined design value, the absolute pressure in control chamber 96 will decrease, causing downward motion of valve surface 88 relative to seat 86, whereupon nozzle extension 84 is vented to the atmosphere. The increase in pressure communicated to EGR 110 causes the pintle to move downwardly, thereby reducing the flow of EGR which causes an increase in the absolute pressure to chamber 96 an mount sufficient to place transducer 10 in an equilibrium position once again. An exhaustive treatment of venturi vacuum transducer operation in an exhaust gas recirculation system is given in the Society of Automotive Engineers Technical Paper No. 800824.

The embodiment of the invention as shown and described above is representative of the inventive principle stated therein. It is to be understood that variations and departures can be made from the embodiment as shown without, however, departing from the scope of the appended claims.

What is claimed is:

1. A pressure transducer for an internal combustion engine exhaust gas recirculation (EGR) system, said system having fluid lines connected to a carburetor venturi vacuum port, an EGR control valve, a ported manifold vacuum port in said carburetor, and a control pressure signal source, said transducer comprising, (a) housing means, said housing means including structure defining a cavity therewithin;

(b) pressure responsive means disposed within said cavity, said pressure responsive means including a resilient diaphragm connected around the outer periphery thereof to said housing means;

(c) means for effecting a seal between said diaphragm and said housing means along a surface radially inwardly from the outer periphery thereof for dividing said diaphragm into outer and inner pressure responsive portions;

(d) reaction plate means connected to said diaphragm outer portion and said diaphragm inner portion for maintaining a spaced relationship therebetween and for movement therewith;

(e) means for biasing said reaction plate means and said diaphragm inner portion in one direction;

(f) said housing means, said diaphragm outer portion, and said reaction plate means cooperating to define a vacuum chamber;

(g) said reaction plate means and said diaphragm inner portion cooperating to define a vent chamber;

(h) said inner diaphragm portion and said housing means cooperating to define a control pressure chamber;

(i) said housing means including, (i) means defining a vent port for communicating atmospheric air to said vent chamber;

(ii) means defining a fluid pressure signal output port adapted for connection to said EGR control valve line;

(iii) means defining a first vacuum signal supply port adapted for connection to said ported manifold vacuum line and in fluid communication with said vent chamber, and (iv) means defining a second vacuum signal supply port adapted for connection to said carburetor venturi vacuum line; and (j) means defining a valve seat disposed in said vent chamber and a valve surface movable with said reaction plate means toward and away from said valve seat, for regulating the fluid pressure at said output port means in response to pressure changes in said control chamber, vent chamber and vacuum chamber.

2. The device as defined in claim 1 wherein, (a) said means for effecting a seal between said diaphragm and said housing means includes an annularly shaped member;

(b) said housing means includes an internal annular side wall portion, said side wall portion conforming generally to the contour of said annular member.

3. The device defined in claim 1 wherein said means for effecting a diaphragm seal includes annularly shaped member and an annular side wall portion of said housing, which are conically tapered.

4. The device as defined in claim 1, wherein said means defining at least one of said vacuum ports includes, (a) means defining a nipple extending exteriorly of said cavity and having a first passageway therethrough; and (b) a second passageway defined by cooperating surface portions of said seal effecting means and said diaphragm, said second passageway communicating said first passageway with said vacuum port.

5. The device as defined in claim 1 wherein said first portion of said means defining said output fluid port is defined by a radially inwardly extending tubular portion, said tubular portion projecting within said vent chamber and further having a downwardly extending end portion, said end portion having said valve seat formed thereon.

6. The device as defined in claim 1 wherein said reaction plate means includes, (a) an upper member having a generally disc-shaped portion and a centrally located downwardly depending tubular portion;

(b) a lower member having a generally disc-shaped configuration; and, (c) said disc-shaped portion has a peripheral bead sealingly engaging surface portions of said diaphragm.

7. The device as defined in claim 1 wherein said valve surface is defined by an elastomeric insert connected to said reaction means for movement therewith.

8. A pressure transducer for an internal combustion engine exhaust gas recirculation (EGR) system, said system having fluid lines connected to a carburetor venturi vacuum port, an EGR control valve, a ported manifold vacuum port in said carburetor, and a control pressure source, said transducer comprising, (a) housing means, including structure defining a cavity therewithin;

(b) pressure responsive means disposed within said cavity, said pressure responsive means including a resilient diaphragm connected around the outer periphery thereof to said housing means;

(c) means for sealingly connecting said diaphragm to said housing means along an annular surface radially inwardly from the outer periphery thereof, said connecting means dividing said diaphragm into outer and inner pressure responsive portions;

(d) reaction plate means connected to said diaphragm outer portion and said diaphragm inner portion for maintaining a spaced relationship therebetween and for movement therewith;

(e) means for biasing said reaction plate means and said diaphragm inner portion in one direction;

(f) means defining a vacuum chamber adapted for fluid connection to said carburetor venturi vacuum line and defined by the space between said housing means, said diaphragm outer portion, and said reaction plate means;

(g) means defining a vent chamber adapted for fluid connection to said ported manifold vacuum line and defined by the space between said reaction plate means and the top surface of said diaphragm inner portion;

(h) means defining a control pressure chamber adapted for fluid connection to said control pressure line, said control pressure chamber defined in part by the space between said inner diaphragm portion and said housing means;

(i) said housing means further including, (i) vent means for communicating atmospheric air to said control chamber, (ii) means defining an output fluid pressure signal port having a first portion disposed within said control chamber and terminating in a valve seat, said means defining said output port including a second portion adapted for fluid connection to said EGR control valve line, (iii) means defining a vacuum port adapted for connection to said ported manifold vacuum line and in fluid communication with said vent chamber;

(j) means defining a valve surface movable with said reaction plate means toward and away from said valve seat, thereby regulating the fluid pressure at said output port means in response to pressure changes in said vent, control and vacuum chambers.

9. The device as defined in claim 8, wherein, (a) said connecting means includes an annularly shaped member;

(b) said housing means includes an internal annular side wall portion conforming generally to the contour of said annular member; and (c) means for securing said annular member to said housing means wherein said resilient diaphragm is sealingly clamped between said side wall portion and said annular member.

10. The device as defined in claim 8, wherein said connecting means includes an annular member and said housing means includes (a) wall portions conforming to said annular member, and (b) means for securing said annular member to said wall portion including, (i) a plurality of radially outwardly extending tabs;

(ii) a plurality of circumferentially spaced openings with said tabs in locking engagement therewith.

11. The device defined in claim 8, wherein said sealing connecting means includes annularly shaped member and correspondingly shaped annular said side wall portions of said housing means which are conically tapered.

12. The device as defined in claim 8, wherein said means defining at least one of said vacuum ports includes, (a) means defining a nipple extending exteriorly of said cavity and having a first passageway therethrough; and (b) a second passageway defined by cooperating surface portions of said connecting means and said diaphragm, said second passageway communicating said first passageway with said port.

13. The device as defined in claim 8 wherein said first portion of said means defining said output fluid port is defined by a radially inwardly extending tubular portion, said tubular portion projecting within said vent chamber and further having a downwardly extending end portion, with said valve seat provided thereon.

14. The device as defined in claim 8, wherein said reaction plate means includes, (a) an upper member having a generally disc-shaped portion and a centrally located downwardly depending tubular portion;

(b) a lower member having a generally disc-shaped configuration; and (c) said upper member disc-shaped portion has a peripheral bead sealingly engaging surface portions of said diaphragm.

15. The device as defined in claim 8, wherein said valve surface is defined by an elastomeric insert connected to said reaction means for movement therewith.

* * * * *